United States Patent [19]

Heymann

[11] Patent Number: 4,471,501

[45] Date of Patent: Sep. 18, 1984

[54] TWO PIECE KNOCKDOWN SHOWER STALL

[75] Inventor: Robert A. Heymann, Thurston, Wash.

[73] Assignee: Hytec, Inc., Tumwater, Wash.

[21] Appl. No.: 403,297

[22] Filed: Jul. 30, 1982

[51] Int. Cl.[3] ..... A47K 3/22

[52] U.S. Cl. ..... 4/599; 4/596; 4/600; 4/612; 4/613

[58] Field of Search ..... 4/663, 614, 613, 612, 4/596–599; 52/79.1, 264

[56] References Cited

U.S. PATENT DOCUMENTS

| | | | |
|---|---|---|---|
| 2,220,482 | 11/1940 | Fuller | 4/663 |
| 2,282,362 | 5/1942 | Johnson | 4/614 X |
| 3,149,347 | 9/1964 | Embroden | 52/264 X |
| 3,675,379 | 7/1972 | Lambert et al. | 52/264 |
| 4,065,885 | 1/1978 | Blick et al. | 52/264 X |
| 4,080,710 | 3/1978 | Hess | 52/264 X |
| 4,129,968 | 12/1978 | Royer | 52/264 |
| 4,238,858 | 12/1980 | Maihart | 52/79.1 X |
| 4,423,528 | 1/1984 | Wiedmeier | 4/614 |

*Primary Examiner*—Henry K. Artis
*Attorney, Agent, or Firm*—Seed and Berry

[57] ABSTRACT

A two-piece shower stall formed as an integral unit and thereafter separated and reassembled after placing a gasket intermediate an upper and lower section formed by the separation. A securing belt is preferably formed integral with the one-piece unit at the area of intended separation and serves to reinforce the shower stall during separation and provide a means for releasably securing the upper section and lower section together. The gasket intermediate the upper section and lower section preferably extends into the interior of the shower stall to provide a watertight seal.

4 Claims, 6 Drawing Figures

FIG. 1
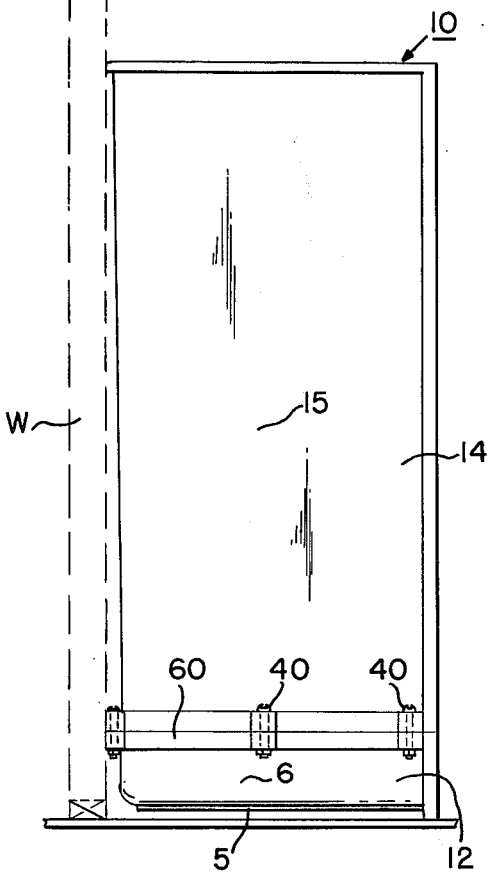
FIG. 2
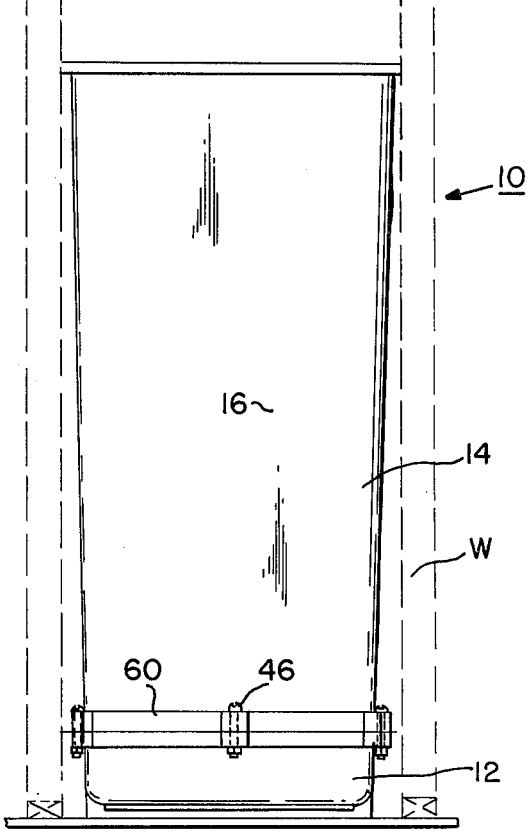
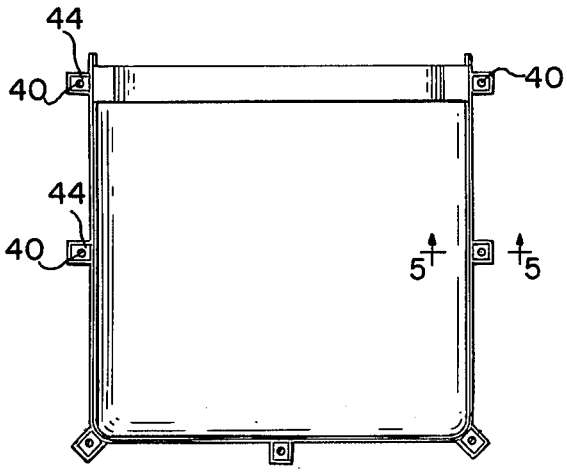
FIG. 3

TWO PIECE KNOCKDOWN SHOWER STALL

DESCRIPTION

1. Technical Field

This invention relates to shower stalls, more particularly to a two-piece shower stall unit which is detachable to aid installation, and a method of fabricating same.

2. Background Art

Shower stall units are often installed in bathrooms in addition to or in place of conventional bathtubs. Shower stalls have the advantage of requiring less space than a bathtub, and additionally, they often provide a more tightly sealed area than a bathtub/shower curtain combination. Existing shower stalls are usually one of two basic types. The first type include a bottom piece with separate sides built around it. The second type include a bottom and three sides formed of one piece of Fiberglas or the like. A hinged door is generally attached to the molded Fiberglas piece.

The multiple-piece shower stall units are undesirable in that they require extra time and manpower to assemble and often do not fit together snugly. Loose fitting joints in a shower stall create difficulties as water may leak through such joints or mold or mildew accumulate therein. Although caulking may be used to seal such joints, it often requires maintenance or replacement during the lifetime of the shower stall. Because of these disadvantages ot the multiple-piece units, one-piece units have gained increased acceptance and popularity. Because there are no joints between the sides or bottom of a one-piece unit, many of the problems associated with shower stalls are eliminated. An unfortunate drawback of the one-piece units, however, is their size. Although one-piece units may be easily installed in new homes or buildings, it is often difficult to fit such units into bathrooms of existing homes or other buildings. Doorways, tight corners, or cramped bathroom layouts often make the task of moving the one-piece unit into a bathroom difficult if not impossible. As cramped locations are often most in need of the space-saving attributes of a shower stall, overcoming this difficulty is desirable.

DISCLOSURE OF THE INVENTION

It is an object of this invention to provide a shower stall which will fit through doorways, around tight corners, and through cramped layouts to allow installation of the shower stall into an existing bathroom.

It is another object of this invention to provide such a shower stall which will not be susceptible to leaks at the joints and will not require caulking to seal.

It is another object of this invention to provide a method of fabricating such shower stalls.

These and other objects of the present invention, which will become more apparent as the invention is more fully described below, are obtained by fabricating a shower stall of Fiberglas or similar material as a one-piece unit. Included in the outer portion of the shower stall near the bottom of the shower stall is a securing belt formed of Fiberglas of increased thickness as compared to the stall walls. The securing belt includes intermittently spaced wood blocks which extend outwardly from the securing belt and are encased in Fiberglas. After the shower stall is fabricated as a one-piece unit, the stall is cut through the middle of the securing belt to create a two-piece unit. The stall is then reassembled after inserting a T-shaped gasket intermediate the two pieces and bolting the two pieces together by inserting bolts through the wood blocks of the securing belt. The two shower pieces remain secured together during shipment to the installation site. If the assembled unit is unable to fit into the room where it is to be installed, it may be disassembled, or knocked down, as necessary to fit through a doorway, hallway or the like. When disassembled, the shower stall comprises a relatively small bottom section and an open-ended upper section having a C-shaped cross-section. Because of its size, the bottom section can easily be carried through a narrow hallway or doorway. The upper section, because of its C-shaped cross-section, can be maneuvered through doorways by placing the door frame within the interior of the C-shaped cross-section. After the unit has reached the room where it is to be installed, it can then be reassembled by merely bolting the pieces back together. Once reassembled, the shower stall may be installed in place.

BRIEF DESCRIPTION OF THE DRAWINGS

FIG. 1 is a side elevation view of one of the sides of the two-piece shower stall of this invention.

FIG. 2 is a side elevation view of the rear of the two-piece shower stall of this invention.

FIG. 3 is a top plan view of the shower stall of this invention.

BEST MODE FOR CARRYING OUT THE INVENTION

Figure 4:
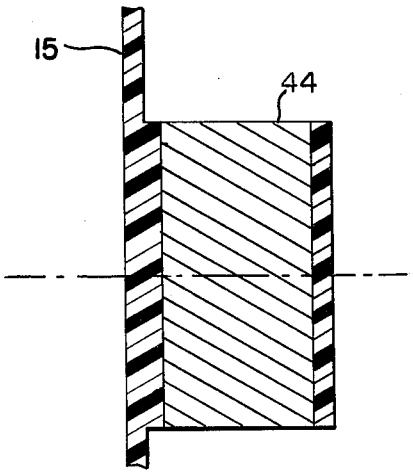
FIG. 4 is a side elevation view illustrating a wood block in the securing belt after a shower stall unit has been fabricated as a single unit but before it has been cut.

An assembled shower stall unit 10 embodying the principles of this invention is illustrated in FIGS. 1, 2 and 3.

The lower section 12 of the shower stall is secured to an upper section 14 by a series of bolts 40 which extend through wooden blocks 44 encased in a securing belt 60 which extends around the upper section 14 and lower section 12, as seen in FIGS. 1 and 2. The lower section 12 preferably includes a plurality of sides 6 which extend upward from the bottom 5 of the lower section. This arrangement keeps the intersection between the upper section 14 and the lower section 12 above the normal level of standing water in a shower stall. In the shower stall 10 illustrated herein, the sides 6 rise nine inches from the bottom 5. It will be obvious to those of ordinary skill in the art, however, that this height could be varied without deviating from the spirit of this invention.

The upper section 14 includes sides 15 and rear 16, which taper inwardly from top to bottom to accommodate the encased blocks 44 which extend outwardly from the sides 15 and rear 16. The outermost surface of the material encasing the blocks 44 is preferably in the same vertical plane as the top of the sides 15 or rear 16 to permit the shower stall 10 to be installed snugly against an interior wall W as seen in FIG. 1.

Figure 5:
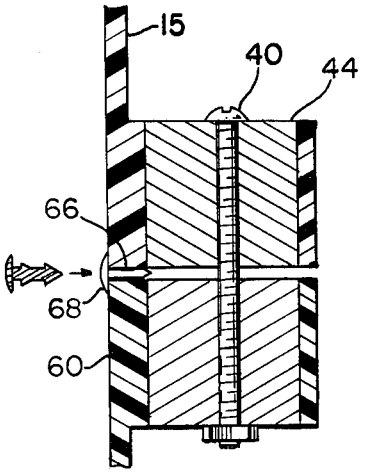
FIG. 5 is a side elevation view of a wood block in the securing belt taken through line 5—5 of FIG. 3 illustrating the block after the shower stall unit has been cut in two.
Figure 6:
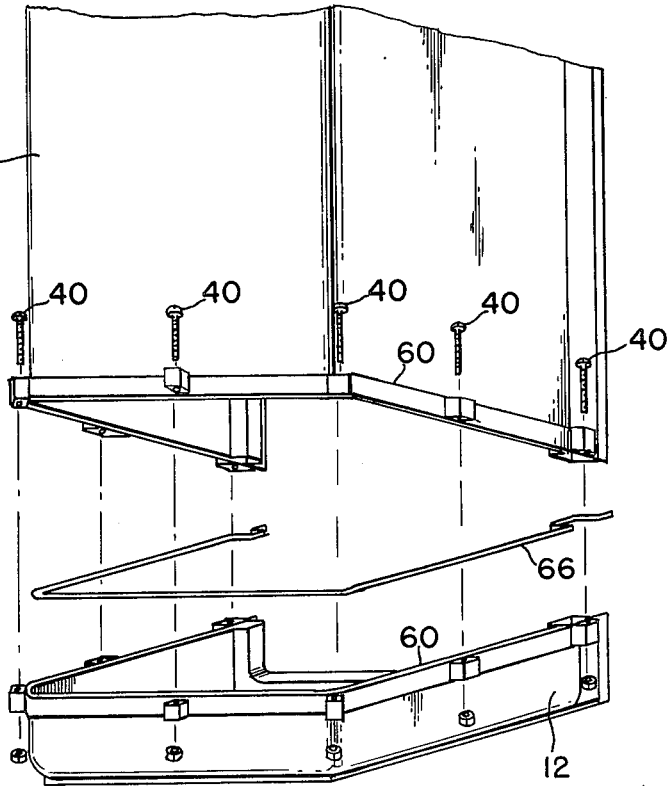
FIG. 6 is an exploded view illustrating the assembly of the two-piece shower stall unit of this invention.

The shower stall 10 is initially fabricated as a one-piece unit. It is preferably fabricated of Fiberglas, although it could be made from other equally suitable material without deviating from the spirit of this invention. An encased block 44 is shown in FIG. 4 prior to separation of the upper section 14 and lower section 12. After the unit is fabricated in one piece, it is cut in two through the middle of the securing belt 60 to form the lower section 12 and upper section 14, as seen in FIG. 6. The securing belt 60 is preferably of greater thickness than the sides 15 and rear 16 of the upper section to facilitate separation of the two sections by increasing the rigidity at the location of the cut. The shower stall 10 is reassembled by placing a T-shaped gasket 66 intermediate the upper section 14 and lower section 12, and securing the two sections together using bolts 40. The transverse bar 68 of T-shaped gasket 66 preferably extends into the interior of the shower stall 10, as seen in FIG. 5, to ensure a good seal. Additionally, because the upper section 14 and lower section 12 are initially formed as a single piece and thereafter separated, a tight fit between the two pieces is ensured. Any recessed area on the bottom surface of the upper section 14, for example, will have a corresponding bulge on the top surface of the lower section 12. Thus, a better fit is obtained than would be if the pieces were fabricated separately.

Although the reference is described herein with reference to a specific embodiment as illustrated in FIGS. 1–6, it will be apparent to one of ordinary skill in the art that many variations could be made to this embodiment without deviating from the general spirit of the invention. For example, other known means of releasably fastening the upper section 14 and the lower section 12 together could be employed. It is not intended that this invention be limited to the specific embodiment disclosed herein, but rather that it include all embodiments within the spirit of the invention.

I claim:

1. A shower comprising:

a lower section having a bottom and a plurality of sides extending upward therefrom;

an upper section having two sides and a back, the sides and back of the upper section each formed integrally with one of the sides of the upper lower section and thereafter separated;

sealing means intermediate the upper and lower sections; and means for releasably securing the upper section, sealing means, and lower section together such that the upper section and lower section may be disassembled for maneuvering into a desired location prior to installation and reassembled at that location.

2. The shower of claim 1 wherein the sealing means is a T-shaped gasket, the transverse bar of the T extending into the interior of the shower to ensure a good seal and the other bar of the T is on the exterior of the shower; adjacent to the separated edges of the upper section and lower section to cover the separated edges.

3. The shower of claim 1 wherein the top of the lower section and the bottom of the upper section define a securing belt, the securing belt being of generally greater thickness than the sides of the upper section.

4. The shower of claim 1 wherein the securing means comprises:

a plurality of blocks extending outwardly from the exterior surfaces of the upper section and the lower section, each block extending form the upper section being adjacent to and aligned with a corresponding block extending from the lower section, each block extending from the upper section being adjacent to and aligned with a corresponding block extending from the lower section, each block including an aperture extending substantially vertically therethrough, each aperture being aligned with the aperture of the corresponding block; and a plurality of releasable fasteners extending through the aligned apertures of corresponding blocks for securing the upper section, sealing means, the lower section together, such that during reassembly of the upper section and lower section at the desired location, the upper section and lower section may be easily aligned by aligning the aperatus and inserting the fasteners therethrough.

* * * * *